US006443759B1

(12) United States Patent
Matsuda et al.

(10) Patent No.: US 6,443,759 B1
(45) Date of Patent: Sep. 3, 2002

(54) TERMINAL CONNECTOR

(75) Inventors: Takeshi Matsuda; Nobuyuki Mano, both of Tokyo (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/711,033

(22) Filed: Nov. 13, 2000

Related U.S. Application Data

(63) Continuation of application No. PCT/JP00/02720, filed on Apr. 26, 2000.

(30) Foreign Application Priority Data

Sep. 14, 1999 (JP) ..... 11-259804

(51) Int. Cl.[7] ..... H01R 3/00
(52) U.S. Cl. ..... 439/488; 439/519
(58) Field of Search ..... 439/488, 149, 439/135, 519, 521, 892, 893, 136, 791, 796, 797, 801, 522, 727

(56) References Cited

U.S. PATENT DOCUMENTS 5,069,636 A * 12/1991 Shimirak et al. ..... 439/412
5,147,219 A * 9/1992 Gilberts et al. ..... 439/521
5,226,841 A * 7/1993 Thorner ..... 439/801
5,380,227 A * 1/1995 Taylor ..... 439/727
5,423,692 A * 6/1995 Francis ..... 439/355
5,664,971 A 9/1997 Coy ..... 4/36
5,964,625 A * 10/1999 Farley ..... 439/807

FOREIGN PATENT DOCUMENTS

JP 09055268 2/1997 ..... 23/68

* cited by examiner

*Primary Examiner*—P. Austin Bradley
*Assistant Examiner*—Ross Gushi
(74) *Attorney, Agent, or Firm*—Morrison Law Firm

(57) ABSTRACT

A terminal connector includes a knob at its outer end. A knob cover snaps into the knob to enable rotation of the knob. The knob cover has resiliently urged lock tabs which snap over lock steps on the knob and into grooves beyond the lock steps. The sides of the lock tabs engage sides of the grooves to transmit torque to the knob. The knob covers are color coded so that a selected color can be installed on a selected knob to indicate its function. An insertion prevention lid is integrally molded over a plug insertion opening of the knob cover to prevent insertion of a connector plug therein. A frangible perimeter of the insertion prevention lid permits its removal to enable insertion of a connector plug.

13 Claims, 7 Drawing Sheets

TERMINAL CONNECTOR

This application is a continuation of PCT/JP00/02720 filed Apr. 26, 2000.

BACKGROUND OF THE INVENTION

1. Field of the Invention

The present invention relates to a terminal connector having a cover for use in electrical connection, specifically in audio and video equipment.

2. Description of the Related Art

Referring to FIG. 7, a conventional terminal connector, shown generally at 100', includes an electrically conductive terminal plate 14 mounted on an insulative circuit board 10. A terminal 15 is secured to insulative circuit board 10 by a screw portion 17 threaded through a screw hole 16 in terminal plate 14. A knob 19", affixed projecting away from terminal 15 enables screwing and unscrewing of screw portion 17 for making electrical connection, as will be explained. Conventional terminal connectors 100', are generally constructed in a four-gang (shown) or eight-gang (not shown) configurations.

Circuit board 10 includes four cylindrical portions 11. Cylindrical portions 11 are integrally formed on a first surface of circuit board 10 and surround part of terminals 15 near the first surface of insulative circuit board 10. Cylindrical portions 11 help avoid lead wire shorts and reduce the chance of electrical contact with a person or an object. Knob 19" of terminal 15 also protrudes away from the first surface. Cylindrical portions 11 each have at least one lead wire insertion notch 12 in an outer periphery.

A through hole 13, formed in insulative circuit board 10, accommodates adjustable screw portion 17 of terminal 15. Screw portion 17 is centered in cylindrical portion 11. Around through hole 13, a plurality of insertion holes 20 permit insertion of one or more press-in lock pieces 21 and a terminal portion 22 of terminal plate 14 into selected insertion holes 20 to fix terminal plate 14 firmly to insulative circuit board 10.

A fit hole 25, shaped to receive plug connection portion 23, passes through the center of knob 19". A plug insertion opening 26, having a diameter greater than that of fit hole 25, is formed at the top of knob 19" for guiding as will be described.

A terminal body 59', made from electrically conductive material, includes cylindrical plug connection portion 23, suitable for accepting insertion of a conventional banana tip, a wire end, or other conductor. Also included in terminal body 59', a collar 18 is pulled down into stabilizing contact with insulative circuit board 10 when screw portion 17 is tightened. Terminal body 59' accepts a press fitted knob 19" to form terminal 15.

Terminal body 59' is conventionally formed by cold forging or a similar process. Through cold forging, conventional cylindrical plug connection portion 23, collar 18, and screw portion 17 are simultaneously formed.

After integration of terminal plates 14 to insulative circuit board 10, terminals 15 are threaded into terminal plates 14 through screw holes 16. When each screw portion 17 is tightened, collar 18 of terminal 15 contacts terminal plate 14 and an end portion of screw portion 17 protrudes below a second surface of insulative circuit board 10. After tightening, an end portion of screw portion 17 is mechanically flattened to form a preventive bulged portion 31 and disrupt a continuous helical thread formed on screw portion 17. Preventive bulged portion 31 prevents terminal 15 from disengaging screw hole 16 or from being lost during later adjustment.

Once terminal plates 14 and terminals 15 are connected to circuit board 10, knobs 19" are loosened sufficiently to allow insertion of at least one lead wire (not shown).through insertion notches 12. When screw portion 17 of terminal 15 is tightened toward screw hole 16 in terminal plate 14, a bottom surface of collar 18 and a top surface of terminal plate 14 sandwich the lead wire (not shown) for electrical contact. A banana plug (not shown), or other conductor, may be inserted into terminal 15, through plug insertion opening 26 and into plug connection portion 23, for electrical connection to the lead wire. More than one lead wire may be captured this way, and connected to a connector inserted into plug connection portion 23 or alternatively to terminal portion 22.

Referring additionally to FIG. 6, conventional terminal connectors 100', positioned now in an eight-gang configuration, illustrate positioning of insertion notches 12 through an outer periphery of terminals 15. Here, knobs 19" are labeled 19"*a* through 19"*d,* indicating each individual knobs 19" within the configuration.

Referring additionally to FIG. 5, a non-conventional terminal connector 100, previously developed by the applicant, includes electrically conductive terminal plate 14 mounted to insulative circuit board 10'. Terminal 15 is secured to insulative circuit board 10' by screw portion 17 threaded into screw hole 16 in terminal plate 14. A knob 19', fixed projecting away from terminal 15 enables screwing and unscrewing of screw portion 17 for making electrical connection, as will be explained.

Cylindrical portion 11, surrounding a part of terminal 15 near the first surface of insulative circuit board 10', helps avoid lead wire shorts and reduces the chance of electrical contact with a person or an object. Cylindrical portion 11 is formed cylindrically about a center axis and has at least one wire insertion notch 12 in its outer periphery. Cylindrical portion 11 includes at least one lock portion 38 protruding from an upper edge of cylindrical portion 11 and facing the central axis. Lock portions 38, combined with retention portions 39 (later described) act to prevent terminal 15 from separating from terminal plate 14. In this figure, insulative circuit board 10' has four cylindrical portions 11 formed on the first surface.

Each terminal 15 comprises knob 19' protruding away from the first surface and generally cylindrical in shape. Fit hole 25 contains plug connection portion 23, and passes through the center of knob 19'. Plug insertion opening 26 is formed at the top of fit hole 25. A circular recess at the bottom of fit hole 25 engages a collar 18. Knob 19' is made from an electrically insulating material such as resin.

An electrically conductive terminal body 59 is an integrally formed element with plug connection portion 23 at a first end, and a minor diameter portion 42 at a second end. Terminal body 59 is integrally formed from with plug connection portion 23 suitable for accepting the insertion of a conventional banana tip, a wire end, or other conductor. Collar 18 is disposed at a first intermediate location and contacts plug connection portion 23. A screw portion 17 is disposed at a second intermediate location and contacts a minor diameter portion 42.

Plug connection portion 23, collar 18, screw portion 17, and minor diameter portion 42 all have circular shapes about a common axis. That is, plug connection portion 23 has a cylindrical shape, collar 18 has a disk-like shape, screw portion 17 has a cylindrical-column shape, and minor diameter portion 42 has a cylindrical-column shape. Screw portion 17 contains a continuous helical thread having a minor diameter measured from a central axis of screw portion 17. Minor diameter portion 42 has a diameter, measured from the same central axis, less than the minor diameter of screw portion 17. Minor diameter portion 42 serves as a guide as is later described.

Knob 19' and terminal body 59 are fixed to each other by both the engagement of collar 18 and the swaging of a top rim of plug connection portion 23 to form a complete terminal 15. This engagement prevents terminal body 59 and knob 19' from rotating with respect to each other and from losing contact with each other as terminal 15 adjusts.

Knob 19', on terminal 15, has integral circular retention portions 39, formed around an exterior circumference and projecting away from the central axis. Knob 19' has a diameter, relative to the central axis, smaller than that of lock portions 38 formed on cylindrical portion 11 so as to allow adjustment of terminal 15 within cylindrical portion 11.

The inner diameter of cylindrical portion 11, relative to the central axis of terminal 15, is greater than that of retention portions 39 to allow insertion of terminal 15 from the second surface of circuit board 10'. However, the inner diameter of lock portions 38 is smaller than the outer diameter of retention portions 39 so as to prevent free passage of terminal 15 away from the first surface of circuit board 10' through cylindrical portion 11. Together, lock portions 38 and retention portions 39 retain terminal 15.

Formed on the second surface of circuit board 10' are through holes 43. Through holes 43 have a diameter larger than the inner diameter of cylindrical portion 11, but smaller than the outer diameter of cylindrical portion 11. Through holes 43 pierce the first surface of insulative circuit board 10' and accommodate terminal plate 14.

Also formed around through hole 43, on the second surface of circuit board 10', is a plurality of integral insertion slots 40 with lock steps 41 for guiding and retaining terminal projections 22 of terminal plate 14. Lock steps 41 are formed about a central axis of through hole 43 perpendicular to terminal portions 22 of terminal plate 14.

Each terminal plate 14, consisting of an electrically conductive material, is formed as a disk portion having a central axis and contacts collar 18 of terminal 15 around cylindrical threaded screw hole 16. Screw hole 16 enables threaded electrical contact between terminal 15 with screw portion 17 and terminal plate 14.

In each terminal connector 100, since minor diameter portion 42 has a diameter smaller than that of screw hole 16, minor diameter portion 42 functions to align and guide terminal plate 14 during assembly. After assembly of terminal connector 100, banana clips, wire leads or other contacts may be inserted in plug insertion opening 26 of terminal 15 or through insertion notches 12 of cylindrical portion 11, to enable electrical contact to terminal projections 22 of terminal plate 14.

Now collectively referring to FIGS. 5 through 7, when such eight or four-gang terminal connectors 100, 100' are used, individual knobs 19', 19" may be selectively colored to indicate specific signal use. For example, in FIG. 6 knobs 19"*a*, 19"*b* may be formed in a red color to indicate a positive signal use, and knobs 19"*c*, 19"*d* may be colored black to indicate a negative signal use.

The multiple terminal connectors 100, 100' with prelabeled knobs 19', 19" present several problems concerning manufacturing, assembly, and later use.

First, during assembly, knobs 19', 19" are molded in advance in specific colors according to a predicted use. Once molded, knobs 19', 19" are installed into circuit board 10, 10', again according to their predicted use. Thus during assembly, pre-labeled knobs 19', 19" must be pre-positioned thus prohibiting adaptation to real-time customer demand.

Second, during assembly, pre-positioning knobs 19', 19" complicates assembly steps and requires additional manufacturing storage.

Third, manufacture of pre-colored knobs 19', 19" requires a raw material batch separate from the patch used to form insulative circuit boards 10, 10'. This complicates the manufacturing process and increases manufacturing or supplier costs.

Fourth, during assembly of terminal connectors 100, 100' terminals 15 are not replaceable where assembled incorrectly. In FIGS. 6 and 7, bulged portion 31 prevent non-destructive disassembly of terminal 15 from circuit board 10. In FIG. 5, retention portion 39 and lock portion 38 combined with snap-in terminal plate 14 prevent non-destructive disassembly of terminal 15 from circuit board 10'. Thus, preventing salvage of improperly assembled terminal connector 100, 100'. As a result, even a single improperly assembled terminal connector 100, 100' will render a complete four or eight-gang terminal connector defective thereby increasing manufacturing losses and costs.

OBJECTS SUMMARY OF THE INVENTION

It is an object of the present invention to provide a terminal connector allowing color labeling during final assembly.

It is a further object of the present invention to provide a terminal connector whose knob is designed to receive a replaceable snap-on cover.

It is a further object of the present invention to provide a terminal connector whose knob is designed to receive a replaceable snap-on cover containing an insertion preventive lid.

It is a further object of the present invention to provide a terminal connector allowing easy storage, assembly, adjustment, and readjustment that minimizes manufacturing defect rates.

It is a further object of the present invention to provide a terminal connector allowing replaceable non-destructive re-labeling by shape or color.

The present invention relates to a terminal connector including a knob at its outer end. A knob cover snaps into the knob to enable rotation of the knob. The knob cover has resiliently urged lock tabs which snap over lock steps on the knob and into grooves beyond the lock steps. The sides of the lock tabs engage sides of the grooves to transmit torque to the knob. The knob covers are color coded so that selected colors can be installed on a selected knob to indicate its function. An insertion prevention lid is integrally molded over a plug insertion opening of the knob cover to prevent insertion of a connector plug therein. A frangible perimeter of the insertion prevention lid permits its removal to enable insertion of a connector plug.

According to an embodiment of the present invention there is provided a terminal connector comprising: a terminal including a terminal body, a means on a first end of the terminal body for attachment to an external element, a knob on a second end of the terminal body, at least one lock step on an exterior surface of the knob, at least one groove adjacent the lock step in an exterior surface of the knob, a knob cover, the knob cover fitting onto the second end over a portion of the knob, a lock tab resiliently attached to the knob cover, the lock tab resiliently engaging the lock step when the knob cover is pushed onto the knob, and sides of the lock tab engaging sides of the groove to resist relative rotation.

According to another embodiment of the present invention there is provided a terminal according wherein: the lock step on the knob extends radially on the exterior surface of the knob, the groove extends from a bottom edge of the lock step, the groove having a first and a second side perpendicular to the bottom edge of the lock step and generally axial to the knob, and the first and second side transmitting torque from the knob cover to the knob.

According to another embodiment of the present invention there is provided a terminal connector wherein: the knob cover has a generally cylindrical shape surrounding an axial cavity formed concentric to the knob, the lock tab formed in an interior surface of axial cavity, the lock tab having a top surface and a third and a fourth side orthogonal to the top surface, the top surface engaging the lock step to retain the knob cover on the knob, and the third and fourth side disposed parallel to and engaging the first and second side of the groove thereby transmitting torque from the knob cover to the knob.

According to another embodiment of the present invention there is provided a terminal connector wherein the knob cover further comprises: a top portion formed on a top end of the knob cover, a plug insertion opening centered in the top portion axial to the knob, and the plug insertion opening having an inner diameter and permitting plug access into the knob.

According to another embodiment of the present invention there is provided a terminal connector wherein the knob cover further comprising: an insertion prevention lid molded across the plug insertion opening, the insertion prevention lid including a frangible portion connecting the insertion preventive lid to the knob cover, the insertion prevention lid being smaller than an inner dimension of the knob, and the frangible portion permitting easy breakage thereof for removing the insertion prevention lid thereby permitting plug access to the plug insertion opening.

According to another embodiment of the present invention there is provided a terminal connector wherein: the insertion preventive lid and the frangible portion have at least one integral cross groove extending from a central axis to the inner diameter portion of the plug insertion opening, and the cross groove concentrates breaking stress for the frangible portion thereby facilitating the plug access to the plug insertion opening.

According to another embodiment of the present invention there is provided a knob cover comprising: an axial cavity fittable over a knob, a plug insertion opening at an end of the axial cavity, an insertion prevention lid integrally molded across the plug insertion opening, the insertion prevention lid preventing access of a plug to the plug insertion opening, a frangible portion at a perimeter of the insertion prevention lid, and the frangible portion permitting easy breakage thereof for removing the plug insertion prevention lid thereby permitting plug access to the plug insertion opening.

According to another embodiment of the present invention there is provided a terminal connector comprising: an insulative circuit board, a plurality of terminals rotatably fixed to a first surface of the insulative circuit board, the terminals each having a knob fixed into a top portion of the terminal, a knob cover replaceably fixed onto a top portion of at least one knob, the knob cover permitting manual rotation of the knob on the terminals for attachment to the circuit board, and the knob cover including a selectable color for identifying a function of its terminal.

According to another embodiment of the present invention there is provided a terminal connector wherein: each of the knobs on the insulative circuit board have an identical color.

According to another embodiment of the present invention there is provided a terminal connector further comprising: a plurality of lock steps radially disposed on the knobs, a plurality of lock tabs on an interior diameter of the knob cover, and the knob cover fixed onto the knob by elastically engaging each of the lock tabs to each of the lock steps thereby replaceably retaining the knob cover on the knob.

According to another embodiment of the present invention there is provided a terminal connector comprising: an insulative circuit board, a plurality of terminal plates affixed to a second side of the insulative circuit board, each the terminal plate having a screw hole, a plurality of terminals each having threaded portions threadably engaged to each terminal plate, means for preventing the terminals from losing threaded engagement to the terminal plates, a knob covering a first portion of each terminal to enable manual rotation of each terminal, a knob cover fitted and fixed to each knob, and each knob cover including a selectable color for identifying a function of its terminal.

According to another embodiment of the present invention there is provided a terminal connector wherein: a top portion of each knob cover has an integrally formed plug insertion opening coaxial to each knob, the plug insertion openings having an inner diameter, and an improper insertion preventive lid detachably attached to an inner diameter thereby covering the plug insertion openings.

According to another embodiment of the present invention there is provided a terminal connector wherein: a top portion of each knob cover has an integrally formed plug insertion opening coaxial to each knob, the plug insertion opening having an inner diameter, and improper insertion preventive lid detachably attached to an inner diameter thereby covering the plug insertion opening.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
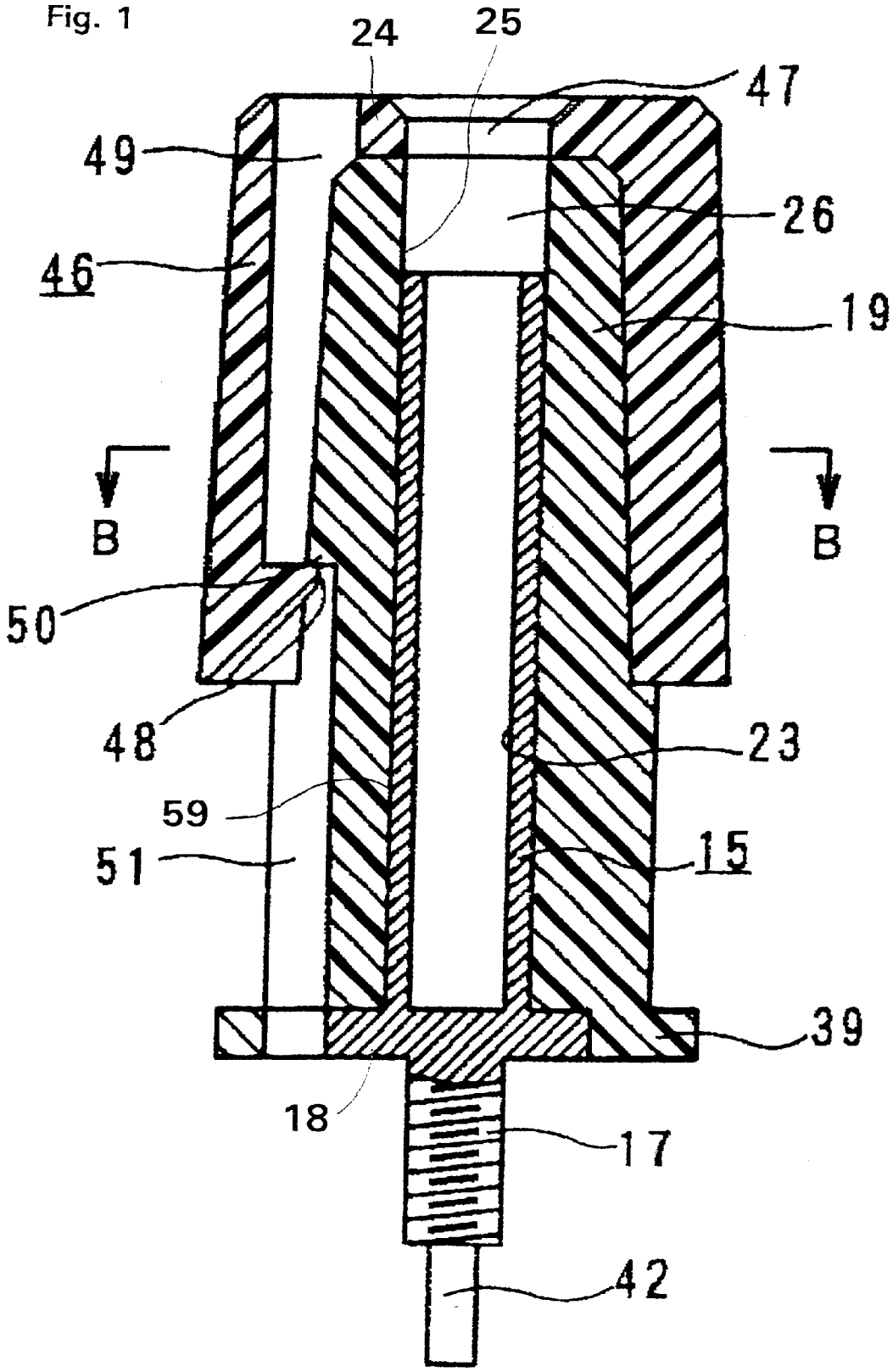
FIG. 1 is a sectional view taken along line A—A of FIG. 2(A), showing an embodiment of the terminal according to the present invention.

Referring to FIG. 1, an electrically conductive terminal body 59 is an integrally formed element with a plug connection portion 23 at a first end, and a minor diameter portion 42 at a second end. A collar 18 is disposed at a first intermediate location along terminal body 59. A threaded screw portion 17 is formed at a second intermediate location, between minor diameter portion 42 and intermediate collar 18, and is co-axial to minor diameter portion 42. Plug connection portion 23, collar 18, screw portion 17, and minor diameter portion 42 all have circular shapes about a common axis. That is, plug connection portion 23 has a cylindrical shape, collar 18 has a disk-like shape, screw portion 17 has a cylindrical-column shape, and minor diameter portion has a cylindrical-column shape.

A terminal 15 includes a knob 19, surrounding the first end of terminal body 59 and covering collar 18 and plug connection portion 23, and a knob cover 46 surrounding a top portion of knob 19. A fit hole 25 contains plug connection portion 23 and passes through the center of knob 19. A circular recess at the bottom of fit hole 25 engages collar 18. Formed at the top of fit hole 25 is a plug insertion opening 26. Knob 19 may be made from an electrically insulating material such as resin.

The electrically conductive terminal body 59 is an integral element with plug connection portion 23 at a first end, and a minor diameter portion 42 at a second end. Terminal body 59 may be formed by a cold forging process or other process. Plug connection portion 23 and plug insertion opening 26 are suitable for accepting the insertion of a conventional banana tip, a wire end, or other conductor. Collar 18 is disposed at a first intermediate location and contacts plug connection portion 23.

Screw portion 17 contains a continuous helical thread having a minor diameter measured from a central axis of screw portion 17. Minor diameter portion 42 has a diameter, measured from the same central axis, less than the minor diameter of screw portion 17. Minor diameter portion 42 serves to guide terminal 15 into threaded engagement with an terminal plate (not shown).

Knob 19 and terminal body 59 are fixed to each other to form a complete terminal 15. This engagement prevents terminal body 59 and knob 19 from rotating with respect to each other and from losing contact with each other as terminal 15 adjusts relative to a terminal plate (not shown).

Knob 19, on terminal 15, has integral retention portions 39, formed around a bottom exterior circumference and projecting away from a central axis. Circular retention portions 39, used in conjunction with lock portions (not shown) prevent terminal 15 from releasing threaded engagement with the above described terminal plate.

Knob 19, on terminal 15, has at least one integral lock step 50 formed perpendicular to the central axis around the outer periphery of knob 19. Lock steps 50 are formed at intermediate positions between retention portions 39 and the top portion of knob 19. Between intermediate lock steps 50 and a bottom portion of knob 19, are anti-slip grooves 51 extend longitudinally and created as drawing dies in the molding process of knob 19. Anti-slip grooves 51 serve to prevent slips, as will be explained.

A knob cover 46, engaging knob 19 through integrally formed lock tabs 48, has an outer periphery formed about a central axis coincident to the central axis of knob 19 and terminal body 59. Knob cover 46 has an internal surface and a top portion 24 defined around a plug insertion opening 47. Lock tabs 48 are formed on the internal surface of knob cover 46 intermediate between the top portion 24 and a bottom edge of knob cover 46. Incident to each lock tab 48 is a corresponding tab molding hole 49 formed during the manufacture of knob cover 46.

Plug insertion opening 47, formed in knob cover 46, has an inner diameter coaxial to the inner diameter of plug insertion opening 26 formed in knob 19. Plug insertion openings 26, 47 allow insertion of banana connectors, wire connectors or the like into plug connection portion 23 thereby enabling electrical connection to collar 18 and threaded portion 17.

During assembly, knob cover 46 is press-fitted over the top of knob 19 and pressed downward toward retention portions 39 formed on knob 19. During the downward motion of knob cover 46, lock tabs 48 contact the outside diameter of knob 19 and transmit expansive hoop-stress to knob cover 46 thereby causing it to elastically expand. As lock tabs 48 pass over lock steps 50 and top portion 24 contacts the top of knob 19, stored expansive hoop-stress causes elastic contraction of knob cover 46 and the engagement of lock tabs 48 into lock steps 50 and grooves 51. Lock tabs 48 have a sloped bottom edge to enable easy assembly and horizontal surfaces (relative to the page), to enable firm engagement with lock steps 50 after fitting.

Grooves 51, have a first and a second side, and function to align lock tabs 48 to lock steps 50. Grooves 51 also function to prevent rotation of knob cover 46 with respect to knob 19. Lock tabs 48 in knob cover 46 are fixed between the first and second sides of groove 51 and thus prevented from slipping as threaded portion 17 is rotated towards the terminal plate(not shown).

Figure 2A:
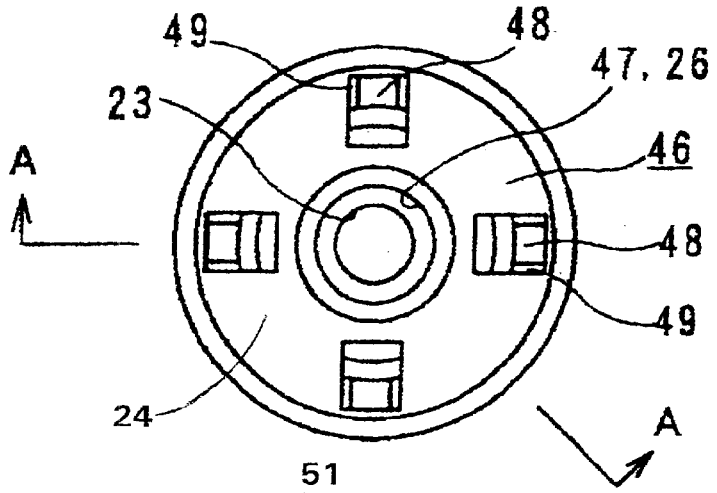
FIG. 2(A) is a plane view of FIG. 1.
Figure 2B:
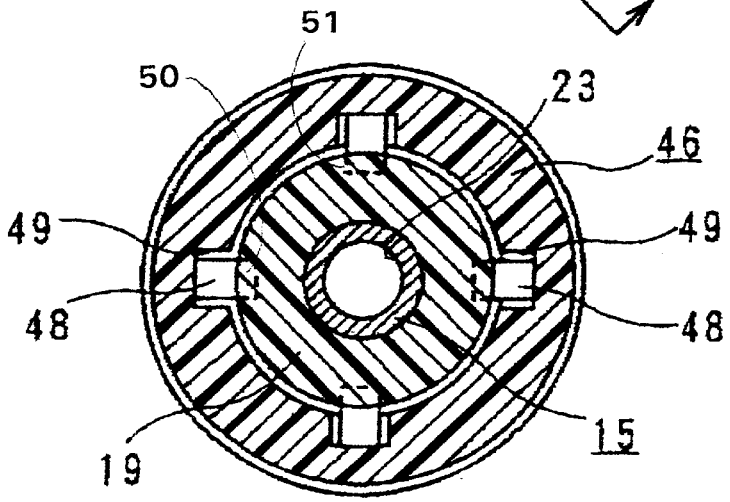
FIG. 2(B) is a sectional view taken along the line B—B of FIG. 1.

As additionally shown in FIGS. 2(A) and 2(B), the inner diameters of plug insertion openings 47, 26 are axially aligned and provide access to plug connection portion 23. In this embodiment, knob cover 46 has four contacting lock tabs 48 each with tab molding hole 49. As described above, each groove 51 formed in knob 19, having the first and the second side, engages a respective first and second side of each corresponding lock tab 48 and fixes lock tab 48 between the first and second side of each groove 51. This engagement prevents knob cover 46 from slipping with respect to knob 19 when threaded portion 17 is adjusted. Each lock step 50, having an lower surface, engages each respective lock tab 48, having an upper surface, to prevent easy disengagement of knob cover 46 from knob 19 during assembly or later adjustment and use. Greater or lesser numbers of lock tabs 48 may be used as long where a similar result is achieved.

In FIGS. 1, 2(A), and 2(B), knob cover 46 is shown with a smooth exterior diameter relative to the central axis. However, alternative embodiments of knob cover 46 may include an exterior surface shaped as a convex polygon relative to the central axis thus facilitating operator adjustment. The exterior surface may also be shaped as an identification source for operators during assembly and later use.

Figure 3:
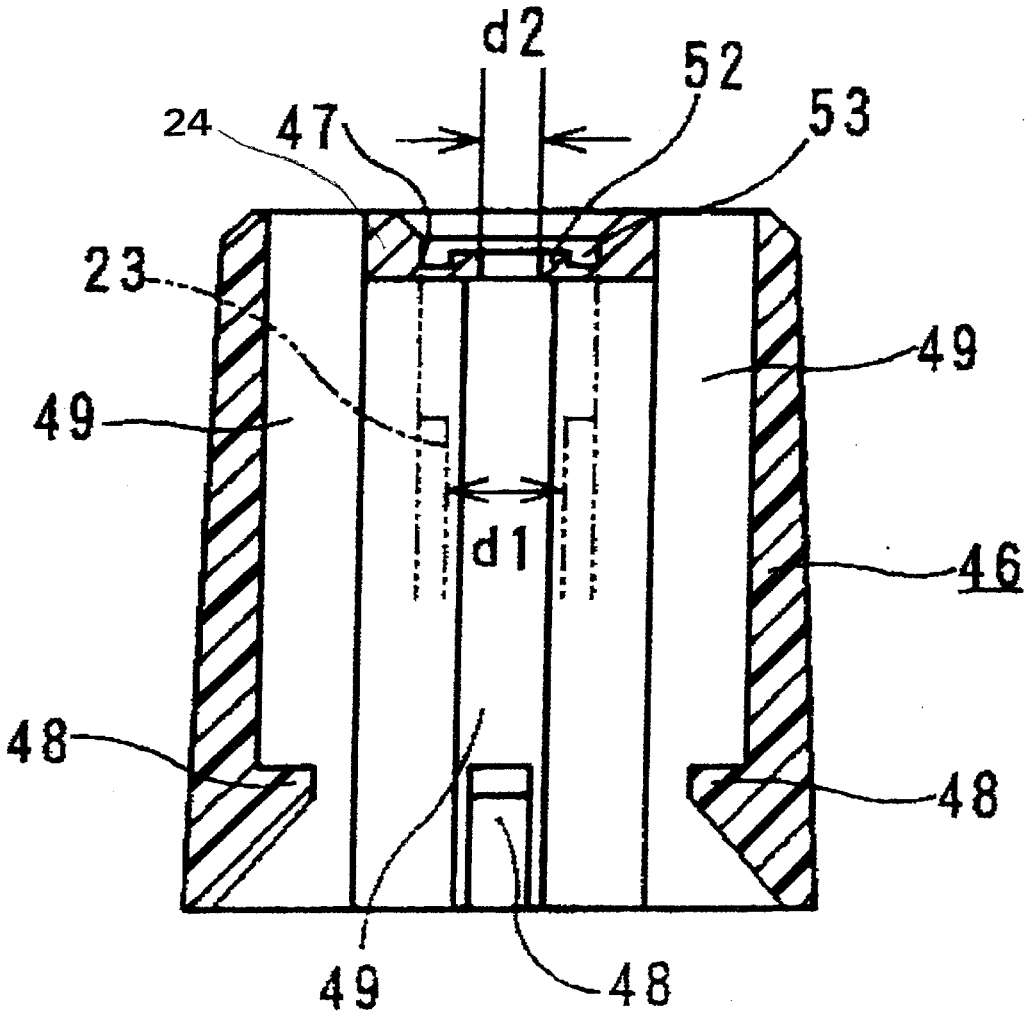
FIG. 3 is a sectional view showing another embodiment of the knob cover.

As additionally shown in FIG. 3, an embodiment of knob cover 46 with top portion 24 contains an integral insertion prevention lid 52. Insertion prevention lid 52 is formed in a generally disk-like shape and extends radially from the central axis of knob cover 46 to contact top portion 24. Insertion prevention lid 52 has a diameter d2 smaller than the inner diameter d1 of plug connection portion 23 to limit access by certain types of plugs.

Knob covers 46, containing insertion prevention lids 52, are used to block plug insertion openings 47 when banana plugs should be inserted and not power supply plugs. Conventional power supply plugs (not shown) generally have an outer diameter of at least d1 and conventional banana plugs (not shown) have a flexible outer diameter able to compress to the diameter of diameter d1. Thus insertion prevention lid 52 serves as both a safety device preventing mis-assembly, and as a visual cue to assembly operators.

Radially surrounding insertion prevention lid 52 is a frangible thin portion 53 enabling insertion prevention lid 52 to be easily broken by an operator wishing to insert a banana plug into terminal 15. This facilitates proper and speedy assembly of terminal connectors 100, 100', including knob covers 46, and to limit defects created by operator mistake.

Figure 4:
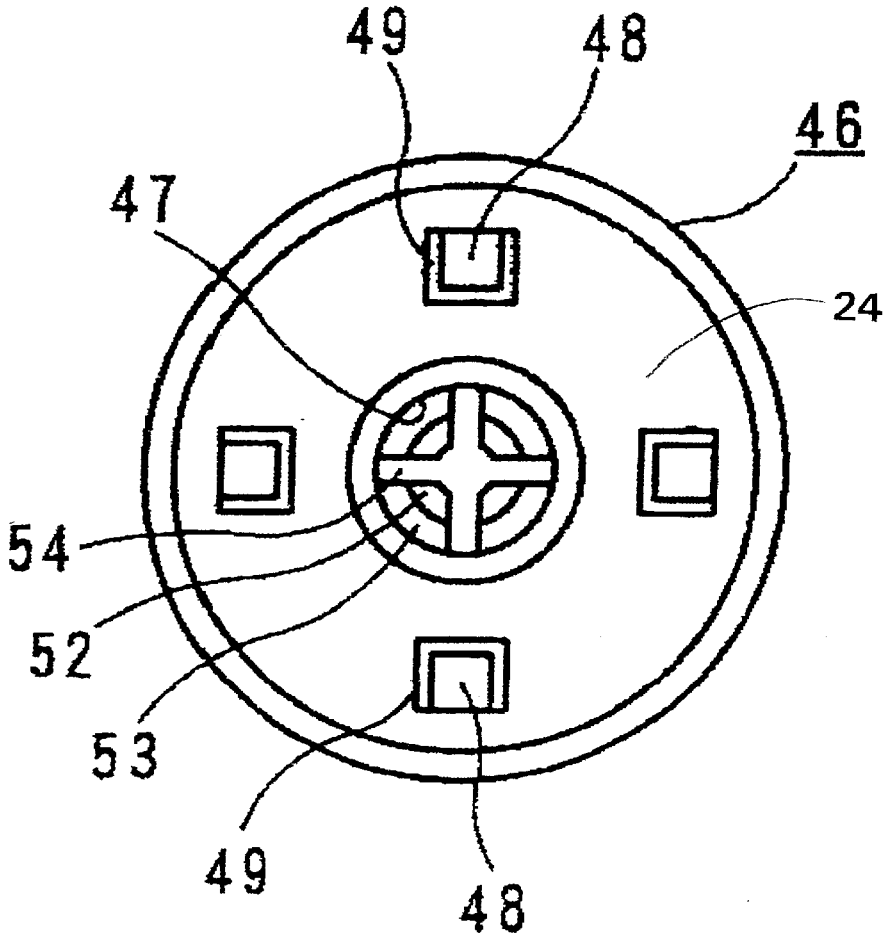
FIG. 4 is a plane view showing another embodiment of the knob cover according to the present invention.
Figure 5:
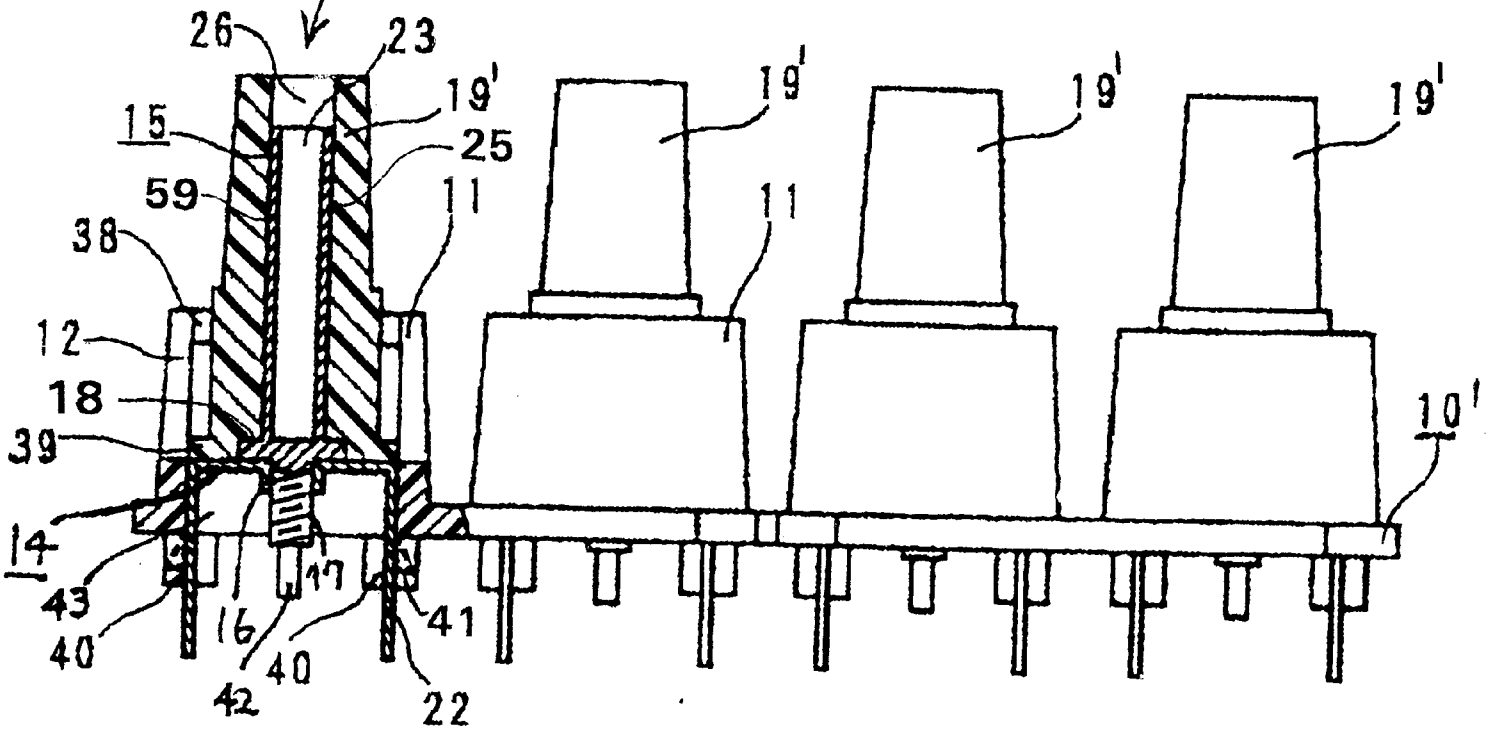
FIG. 5 is a partially-broken front view of a non-conventional terminal connector.
Figure 6:
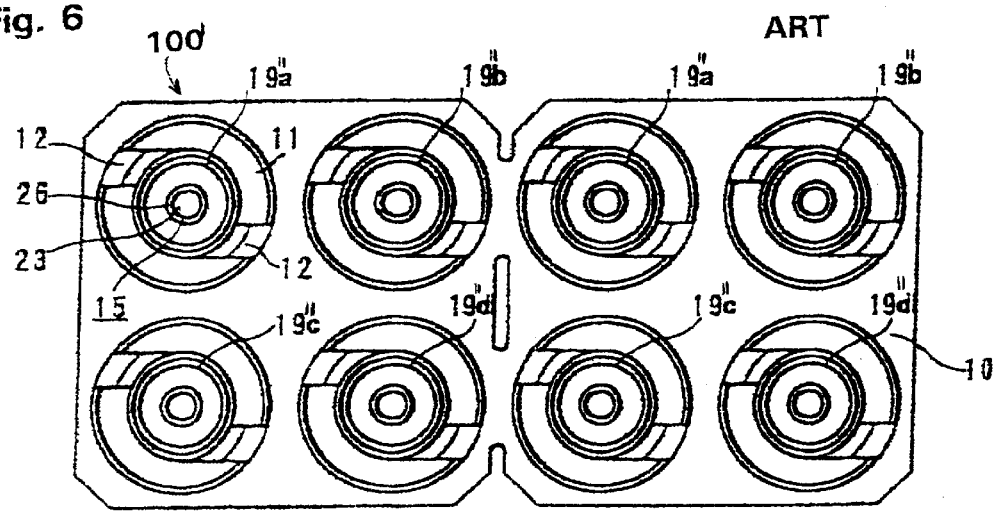
Fig. 6 PRIOR ART
FIG. 6 is a top view of a conventional multiple terminal connector.
Figure 7:
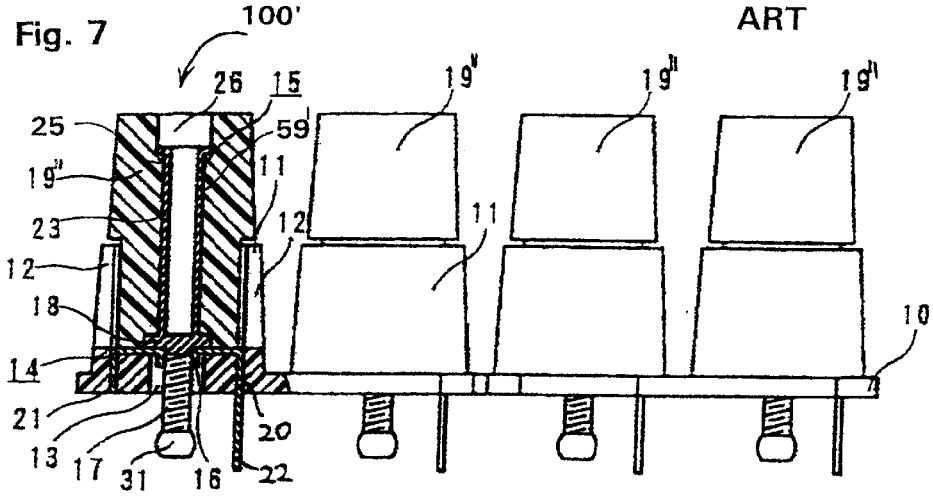
Fig. 7 PRIOR ART
FIG. 7 is a partial front view of a conventional terminal connector.

As additionally shown in FIG. 4, another embodiment of knob cover 46 contains cross grooves 54 spanning thin portion 53 and insertion prevention lid 52. Cross grooves 54 span insertion prevention lid 52 and further weaken the connection between thin portion 53, surrounding insertion prevention lid 52, and top portion 24 thereby preventing unintended damage to insertion prevention lid 52 and terminal 15. Knob covers 46, containing cross grooves 54, may be used during assembly of terminal connectors 100, 100' in electrical distribution devices, thus preventing mistaken insertion of power supply plugs.

There are multiple benefits to the improved design of knob 19 and knob cover 46.

First, insertion prevention lid 52, on knob cover 46, provides beneficial design over conventionally-known detachable improper insertion preventive O-rings, because no separate part supply need to be maintained. Additionally, the combination of insertion prevention lid into knob cover 46 minimizes operator confusion and eliminates the need to incorporate such a function into the pre-assembled terminal 15.

Second, insertion prevention lid 52, once broken during the insertion of a banana plug provides a visual aid to later repair operators as to the proper terminal connector 100, 100' to use.

Third, knob cover 46 covering knob 19 provides a larger outer diameter for gripping by an operator than does the narrower exterior diameter of knob 19. This minimizes operator strain and enables more rapid adjustment.

Fourth, knob cover 46 provides a larger outer diameter for the completed terminal 15 and gives a more pleasing visual appearance to the assembled terminal connectors 100, 100' thus influencing customer demand.

Fifth, each groove 51, formed in the outer diameter of knob 19 functions to prevent unwanted rotation of knob cover 46 with respect to terminal 19. This containment allows secure actuation of terminal 15 relative to a terminal plate and enables rapid operator adjustment during assembly. Under extreme tightening requirements, where the engagement of lock tabs 48 in grooves 51 is found insufficient, both the interior diameter of knob cover 46 and the corresponding exterior diameter of knob 19 may be formed into closely nesting polygons thus providing additional engagement.

Sixth, the outer diameter of knob cover 46 is easily adapted for special identification purposes without causing a negative impact on the engagement function of inner diameter lock tabs 48 to lock steps 50. As a result, the embodiment described for knob cover 46 may easily serve as a general-purpose configuration for general-purpose customers while providing an easily recast special purpose, special design, or special color for larger customers requiring an individualized look.

Seventh, knob covers 46 covering knobs 19 serve as a safeguard for an outside cylindrical portion (not shown) positioned between retention portions 39 and a bottom edge of knob cover 46 opposite top portion 24. This protective function prevents unintended capture of connective wire or other detritus between the knob cover 46 and the cylindrical portion thus minimizing assembly error.

Eighth, since knob covers 46 are installed onto knobs 19 of terminals 15 after main assembly of terminal connectors 100, 100' it is easy to offer rapid custom final assembly in response to last-minute customer requests.

Ninth, since knob covers 46 are installed onto knobs 19 of terminals 15 after main assembly of terminal connectors 100, 100', it is easy to stockpile generic unlabeled terminal connectors 100, 100' without final assembly during times of low customer demand. During times of sudden customer demand a manufacturer may draw against the stockpile to fill rapid customer demand. Thus providing a business advantage to manufacturers using knob covers 46 with knobs 19 since automated assembly lines are difficult and time consuming to change. As a result, quick response to customer orders are enabled, customer satisfaction is correspondingly increased, and steady labor pool may be maintained.

Tenth, re-labeling of terminals 15 on terminal connectors 100, 100' is simplified by requiring only the removal of knob cover 46 and replacement with another knob cover 46 rather than a complete replacement of terminal 15. Additionally, re-labeling knob 19 is less expensive and faster than the disassembly of terminal connector 100, 100'. Thus, re-labeling prevents a single assembly defect from making the entire four- or eight-gang terminal connector 100, 100' defective.

Eleventh, since knob covers 46 and knobs 19 are adaptable to both kinds of terminal connectors 100, 100', knob covers 46 and knobs 19 offer easy adaptation by a variety of manufacturing services.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A terminal comprising:

a terminal body;

means on a first end of said terminal body for attachment to a first external element;

a knob on a second end of said terminal body;

at least one lock step on an exterior surface of said knob;

at least one groove adjacent said lock step in an exterior surface of said knob;

a knob cover;

said knob cover fitting onto said second end over a portion of said knob;

a lock tab resiliently attached to said knob cover;

said lock tab resiliently engaging said lock step when said knob cover is pushed onto said knob; and sides of said lock tab engaging sides of said groove to resist relative rotation.

2. A terminal according to claim 1, wherein:

said lock step on said knob extends radially on said exterior surface of said knob;

said groove extends from a bottom edge of said lock step;

said groove having a first and a second side perpendicular to said bottom edge of said lock step and generally axial to said knob; and said first and second side transmitting torque from said knob cover to said knob.

3. A terminal according to claim 1, wherein:

said knob cover has a generally cylindrical shape surrounding an axial cavity formed concentric to said knob;

said lock tab formed in an interior surface of axial cavity;

said lock tab having a top surface and a third and a fourth side orthogonal to said top surface;

said top surface engaging said lock step to retain said knob cover on said knob; and said third and fourth side disposed parallel to and engaging said first and second side of said groove thereby transmitting torque from said knob cover to said knob.

4. A terminal according to claim 3, wherein said knob cover further comprises:

a top portion formed on a top end of said knob cover;

a plug insertion opening centered in said top portion axial to said knob; and said plug insertion opening having an inner diameter and permitting plug access into said knob.

5. A terminal according to claim 4, said knob cover further comprising:

an insertion prevention lid molded across said plug insertion opening;

said insertion prevention lid including a frangible portion connecting said insertion preventive lid to said knob cover;

said insertion prevention lid being smaller than an inner dimension of said knob; and said frangible portion permitting easy breakage thereof for removing said insertion prevention lid thereby permitting plug access to said plug insertion opening.

6. A terminal according to claim 5, further comprising:

said insertion preventive lid and said thin portion having at least one integral cross groove extending from a central axis to said inner diameter portion of said plug insertion opening; and said cross groove concentrating breaking stress for said frangible thin portion thereby facilitating said plug access to said plug insertion opening.

7. A knob cover comprising:

an axial cavity fittable over a knob;

a plug insertion opening at an end of said axial cavity;

an insertion prevention lid integrally molded across said plug insertion opening;

said insertion prevention lid preventing access of a plug to said plug insertion opening;

a frangible portion at a perimeter of said insertion prevention lid; and said frangible portion permitting easy breakage thereof for removing said plug insertion prevention lid thereby permitting plug access to said plug insertion opening.

8. A terminal connector comprising:

an insulative circuit board;

a plurality of terminals rotatably fixed to a first surface of said insulative circuit board;

said terminals each having a knob fixed into a top portion of said terminal;

a knob cover replaceably fixed onto a top portion of at least one knob;

said knob cover permitting manual rotation of said knob on said terminals for attachment to said circuit board; and said knob cover including a selectable color for identifying a function of its terminal.

9. The terminal connector according to claim 8, wherein:

each said knob on said insulative circuit board having an identical color.

10. The terminal connector according to claim 8, further comprising:

a plurality of lock steps radially disposed on said knobs;

a plurality of lock tabs on an interior diameter of said knob cover; and said knob cover fixed onto said knob by elastically engaging each said lock tab to each said lock step thereby replaceably retaining said knob cover on said knob.

11. A terminal connector comprising:

an insulative circuit board;

a plurality of terminal plates affixed to a second side of said insulative circuit board;

each said terminal plate having a screw hole;

a plurality of terminals each having threaded portions threadably engaged to each said terminal plate;

means for preventing said terminals from losing threaded engagement to said terminal plates;

a knob covering a first portion of each said terminal to enable manual rotation of each said terminal;

a knob cover fitted and fixed to each said knob; and each said knob cover including a selectable color for identifying a function of its terminal.

12. A terminal connector according to claim 10, wherein:

a top portion of each said knob cover has an integrally formed plug insertion opening coaxial to each said knob;

said plug insertion openings having an inner diameter; and an improper insertion preventive lid detachably attached to said inner diameter thereby covering said plug insertion openings.

13. A terminal connector according to claim 11, wherein:

a top portion of each said knob cover has an integrally formed plug insertion opening coaxial to each said knob;

said plug insertion opening having an inner diameter; and and improper insertion preventive lid detachably attached to an inner diameter thereby covering said plug insertion opening.

* * * * *